US010973722B1

(12) United States Patent
Nsien

(10) Patent No.: US 10,973,722 B1
(45) Date of Patent: Apr. 13, 2021

(54) BIRTHING CHAIR

(71) Applicant: Kayla Nsien, Tulsa, OK (US)

(72) Inventor: Kayla Nsien, Tulsa, OK (US)

( * ) Notice: Subject to any disclaimer, the term of this patent is extended or adjusted under 35 U.S.C. 154(b) by 133 days.

(21) Appl. No.: 16/215,087

(22) Filed: Dec. 10, 2018

(51) Int. Cl.

| | |
|---|---|
| ***A61G 15/00*** | (2006.01) |
| ***A61G 13/00*** | (2006.01) |
| ***A61G 7/10*** | (2006.01) |
| ***A63B 7/00*** | (2006.01) |
| *A61H 1/02* | (2006.01) |

(52) U.S. Cl.
CPC ..... *A61G 15/005* (2013.01); *A61G 13/0009* (2013.01); *A63B 7/00* (2013.01); *A61G 7/1059* (2013.01); *A61H 1/0229* (2013.01)

(58) Field of Classification Search
CPC .... A61G 13/0009; A61G 15/005; A61G 7/02; A61G 5/1002; A61G 7/1015; A61G 7/1051; A61G 7/1055; A61G 7/1059
USPC ..... 5/602, 604, 85.1, 89.1, 83.1, 81.1 R
See application file for complete search history.

(56) References Cited

U.S. PATENT DOCUMENTS 307,717 A * 11/1884 Gunold ..... A61G 7/02 5/604
577,419 A * 2/1897 Carver et al. ..... A47C 3/0255 5/124
663,427 A * 12/1900 Eddy ..... A61G 7/015 5/618
759,882 A * 5/1904 Hall et al. ..... A61G 7/02 5/604
826,978 A * 7/1906 Whittington ..... A61G 7/02 5/604
1,455,234 A * 5/1923 Thompson ..... A47C 7/029 297/452.25
2,104,830 A * 1/1938 Collard ..... A61G 15/005 297/325
3,014,224 A * 12/1961 Hall ..... A61G 7/02 5/604

(Continued)

FOREIGN PATENT DOCUMENTS

CA 2527459 A1 5/2006
WO 2012135911 A1 10/2013

OTHER PUBLICATIONS

Nausicaa Medical, Quick Toilet Sling, Published Oct. 19, 2016, at https://www.nausicaa-medical.eu/product/quick-toilet-sling/.

(Continued)

*Primary Examiner* — Robert G Santos
(74) *Attorney, Agent, or Firm* — Margaret Millikin

(57) ABSTRACT

A birthing chair for facilitating labor and delivery of an infant. The birthing chair comprises a seat having a seat base and a detachable seat cushion. The seat base forms an aperture for delivery of an infant therethrough. Leg extensions may be attachable to the seat base for supporting the legs of the mother. The seat base may comprise a joint that opens and moves the seat base and leg extensions laterally and expands the size of the aperture in the seat base. The birthing chair may further comprise a suspension system that enables the mother to operate the chair to adjust her position and height at will. The suspension system allows the mother to move in any direction while seated in the birthing chair and still remain supported in the birthing chair. The suspension system may be adjustable. The birthing chair may further comprise a back, headrest, stirrups and handles.

23 Claims, 4 Drawing Sheets

(56) References Cited

U.S. PATENT DOCUMENTS 3,129,438 A * 4/1964 Hall ..... A47C 27/125 5/695
4,180,062 A * 12/1979 Alberti et al. ..... A61B 5/02411 297/16.1
4,703,975 A * 11/1987 Roberts et al. ..... A61G 15/005 297/183.9
4,911,426 A 3/1990 Scales
5,280,794 A * 1/1994 Degen ..... A61G 15/005 128/845
5,806,114 A * 9/1998 Morgan et al. .... A61G 13/0009 5/602
7,255,666 B2 8/2007 Cardenas
7,266,852 B2 * 9/2007 Davis ..... A61G 7/05769 4/457
7,406,723 B2 * 8/2008 Davis ..... A61G 7/05769 5/706
7,574,761 B2 * 8/2009 Davis ..... A61G 7/05769 5/710
8,365,740 B1 * 2/2013 Ishida ..... A61F 5/3776 128/870
8,566,977 B2 * 10/2013 Davis ..... A61G 7/1028 5/81.1 HS
9,821,188 B2 11/2017 Dwork et al.
2003/0173813 A1 9/2003 Dornauer et al.
2005/0110316 A1 * 5/2005 Perrotti ..... B60R 22/02 297/250.1
2007/0094805 A1 * 5/2007 Davis ..... A61G 7/05769 5/706
2007/0289066 A1 * 12/2007 Davis ..... A61G 7/05769 5/710
2008/0244830 A1 * 10/2008 Davis ..... A61G 7/05769 5/615
2012/0210511 A1 * 8/2012 Davis ..... A61G 7/1051 5/81.1 R
2016/0023051 A1 1/2016 Lauener
2016/0045778 A1 2/2016 Dwork et al.

OTHER PUBLICATIONS

Silvalea, Silva Deluxe Sling, Published Jul. 13, 2017, at http://www.silvalea.com/silvar-deluxe-sling.html.

* cited by examiner

BIRTHING CHAIR

TECHNICAL FIELD OF THE INVENTION

The present invention relates generally to birthing chairs for assisting mothers during pregnancy, labor, delivery and post-delivery, and more particularly, but not by way of limitation, to birthing swings. Methods of assisting with labor and delivery are also provided.

SUMMARY OF THE INVENTION

The present invention is directed to a birthing chair for a mother to facilitate labor and delivery of an infant. The birthing chair comprises a seat, the seat comprises a seat base forming an aperture and a detachable seat cushion connectable to the seat base over the aperture; leg extensions configured to receive the legs of the mother; a joint that laterally opens the seat base and the leg extensions. When the seat cushion is detached from the seat base, the seat permits vaginal delivery of the infant through the seat base.

The invention is further directed to a method of facilitating childbirth, the method comprising the steps of providing a seat having a seat base and a detachable seat cushion on which a mother is situated removing the seat cushion from the seat base to provide an opening for vaginal delivery of an infant through the seat base; and separating the seat base to enlarge the opening through which the infant is delivered.

DETAILED DESCRIPTION OF THE INVENTION

Birthing chairs allow an expectant mother to sit in a vertical posture, aided by the natural forces of gravity which work in tandem with her upright body to facilitate labor and delivery during childbirth. Some studies have shown that the use of a birthing chair expedites labor and delivery and increases the comfort of the mother. This upright posture enables a mother to use the muscles throughout her body to support her own frame and to assist in the expulsion of the infant.

Medical facilities traditionally recline the pregnant mother in a supine position, which contravenes that natural forces of gravity. Along with increased demand for natural childbirth experiences, many patients request birthing chairs, which is motivating hospitals to incorporate this equipment into maternity wards and birthing centers.

Conventional birthing chairs and birthing stools are solid structures, built relatively low to the ground, to enable the mother to brace her feet against the floor while pushing. Conventional birthing chairs do not support the mother's body but simply allow her to rest on the seat. Similarly, conventional birthing chairs do not allow the mother to adjust her position or posture for comfort while simultaneously supporting her body. Some conventional birthing chairs are backless stools which enable a doula or midwife to massage the back of the mother during labor. However, birthing stools offer less support for the mother and are uncomfortable. Some birthing chairs allow the mother to adjust her position but sacrifice significant support and comfort in doing so.

The seat of conventional birthing chairs and stools forms an indentation or inward curvature to allow delivery of the infant while the mother is seated on the chair or stool. Such seats do not fully accommodate the mother and lack padding, cushioning, side support and comfort.

The birthing chair of the present invention overcomes deficiencies of conventional birthing chairs and is useful throughout pregnancy, labor and delivery. The birthing chair of the present invention provides increased comfort and supports the mother's body in any position, whether forward, backward, sideways, diagonally, low or through the use of a suspension system. The suspension system enables the mother to operate the chair to adjust her position and height at will. The birthing chair of the present invention allows the mother to adjust the height of the seat to allow the mother to squat close to the floor or to sit up higher in a vertical yet partially recumbent repose and to elevate her legs during delivery. The birthing chair of the present invention fully accommodates the mother in a comfortable seated position for use during pregnancy, labor and post-delivery, yet allows the removal of a portion of the seat for delivery of the infant. These and other advantages of the present invention will be apparent from the following description of embodiments.

Figure 1:
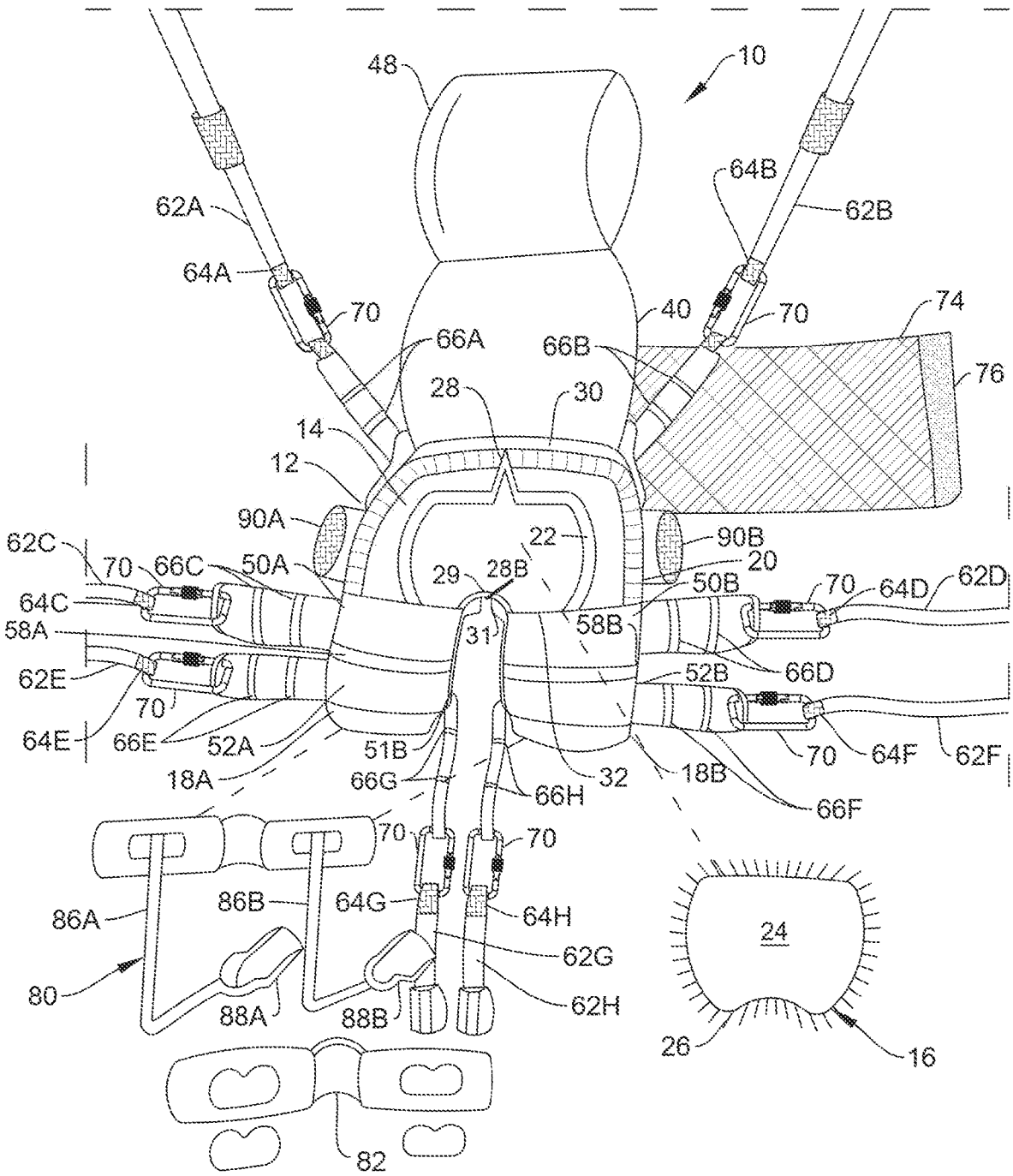
FIG. 1 is an exploded view of an exemplar of a birthing chair constructed in accordance with the present invention.

Turning now to the drawings in general, and to FIG. 1 in particular, there is shown therein an exploded view of a birthing chair 10 constructed in accordance with the present invention. The birthing chair 10 comprises a seat 12 configured to facilitate labor and delivery of an infant. The seat 12 comprises a seat base 14 and a detachable seat cushion 16.

In one embodiment of the invention, the seat 12 forms a U-shape configured to receive the buttocks and thighs of the mother. To that end, the seat base 14 may form leg extensions 18A and 18B which may be integral with the seat 12 or which may be detachable therefrom. The seat base 14 may be any shape configured to receive a mother situated thereon, which includes, by way of example, oval, circular, oblong, rectangular and square shapes. The seat 12 allows the mother to be comfortably positioned in the birthing chair 10.

The seat base 14 preferably is constructed from a durable, waterproof material. Some materials suitable for construction of the seat base 14 include polyester, rayon, mesh, metal, and molded plastic. The leg extensions 18A and 18B also preferably are constructed from a durable, waterproof material, such as polyester, rayon, mesh, metal, molded plastic, polyvinyl chloride, elastomer and polyurethane.

In one embodiment of the invention, the seat 12 further comprises a flared lip 20 contiguous with the seat base 14 and with the leg extensions 18A and 18B and extends outward therefrom at an angle of about 0 to about 150 degrees and upward therefrom from about 0 inches to about 18 inches. The flared lip 20 is contoured to receive the buttocks and legs of the mother and provide greater comfort to her during use of the birthing chair 10 during pregnancy, labor, delivery and post-partum.

The seat 12 may be custom built to the mother's specifications to accommodate her body type and size during pregnancy and post-labor and delivery. The birthing chair 10 fits a variety of body shapes and sized, varying from small to extra-large with a maximum weight capacity of 300 pounds. Generally, the dimensions of the seat 12, including leg extensions 18A and 18B and the flared lip 20, range from about 40 inches to about 65 inches in width, about 40 to about 52 inches in length and about 5 to about 10 inches in depth. In one embodiment of the invention, the seat 12 measures 20 inches wide by 22 inches long, including the flared lip 20 and the leg extensions 18A and 18B, and a depth of 8 inches. The dimensions of the seat 12, not including the dimensions of the leg extensions 18A and 18B but including the flared lip 20, range from about from about 18 inches to about 22 inches in width, about 14 to about 20 inches in length and about 4 to about 8 in depth. In one embodiment of the invention, the seat 12 measures 18 inches wide by 8 inches long, without the leg extensions 18A and 18B but including the flared lip 20 and has a depth of 8 inches.

The leg extensions 18A and 18B hold the legs of the mother while she is positioned in the birthing chair 10. The dimensions of leg extensions 18A and 18B range from about 16 to about 22 including the flared lip 20. In one embodiment of the invention, the leg extensions 18A and 18B are eight inches wide by eight inches long and are integrally formed with the seat bottom 14.

The seat base 14 forms an aperture 22 over which is situated the detachable seat cushion 16, secured to the seat base 14 by a latch. The aperture 22 in the seat base 14 creates a non-obstructive opening in the seat 12 to facilitate natural, vaginal delivery of the infant. The aperture 22 may be of any shape and size such that, when the seat cushion 16 is removed from the seat base 14, the aperture 22 permits delivery of an infant therethrough in a manner yet to be described. In one embodiment of the invention, the aperture 22 formed in the seat base 14 measures from about 12 inches to about 16 inches but may be configured to any shape and size to permit a newborn infant to pass therethrough.

The seat cushion 16 is made from materials that are soft and comfortable to the mother yet strong enough to support her weight. The seat cushion 16 is sized to cover the aperture 22. In one embodiment of the invention, the seat cushion 16 may be rectangular and oblong but may be any shape and size to match the shape and size of the apertures 22. The seat cushion 16 is composed of an inner foam cushion protected with a cover 24. Suitable foam materials useful in the construction of the seat cushion 16 include upholstery foam, bonded dacron upholstery foam, vinyl, polyvinyl, polyurethane, elastomer. The cover 24 of the detachable seat cushion 16 may be made from polyester, plastic, rayon and hard plastic materials and may be any color or design. The cover 24 of the detachable seat cushion 16 may be removable for washing or cleaning. The detachable seat cushion 16 may have a slightly elevated shape designed with borders and ridges 26 for custom positioning and comfort.

Figure 2:
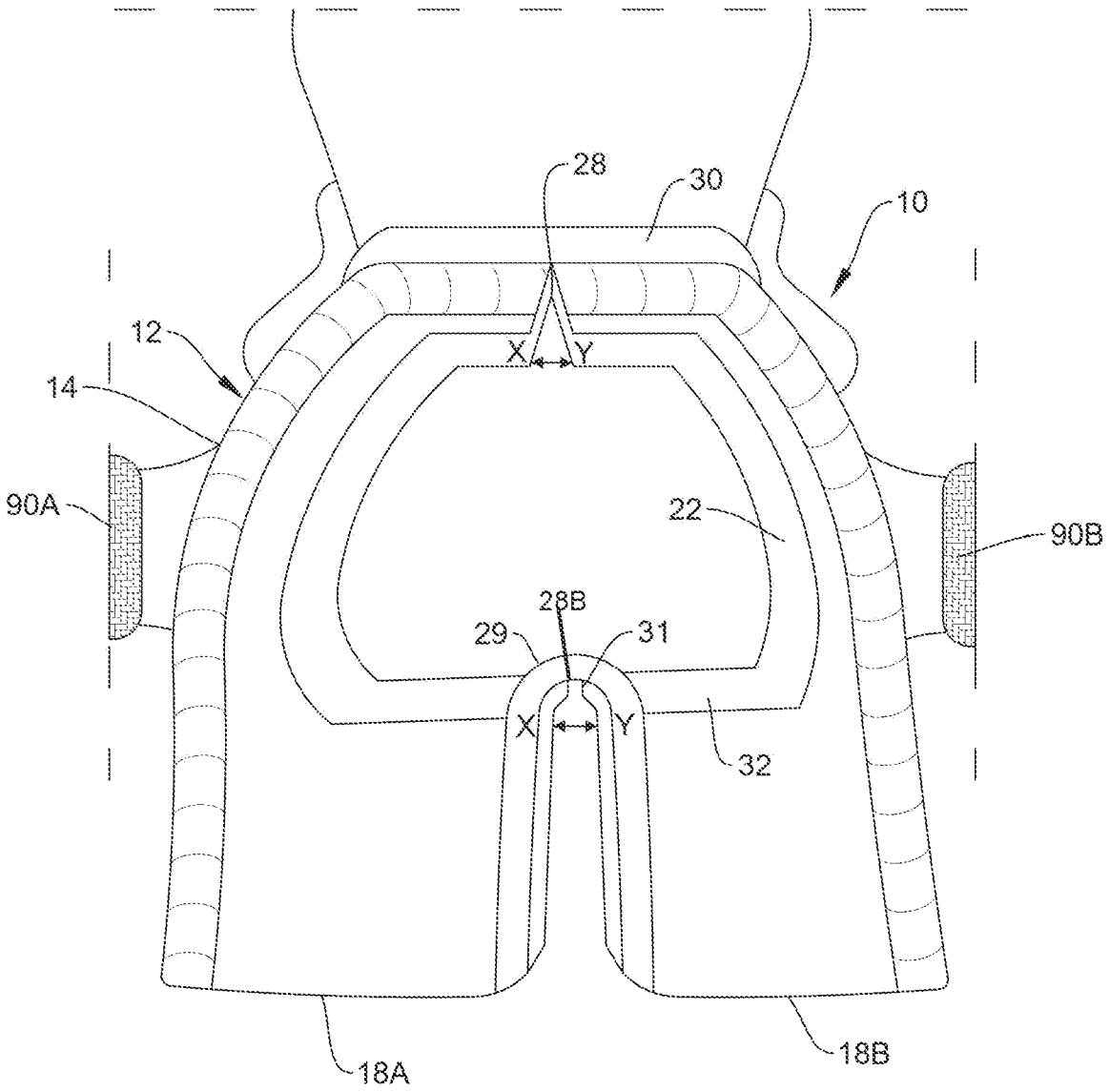
FIG. 2 is a top plan view of the seat base of the birthing chair of FIG. 1 wherein the joint activated.
Figure 3:
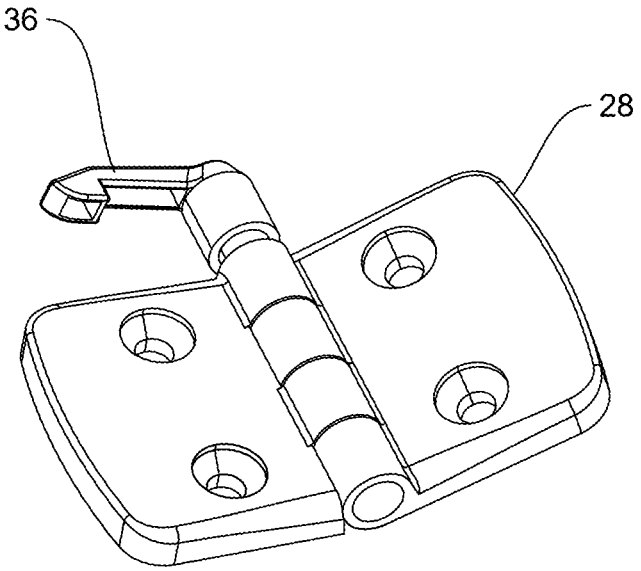
FIG. 3 illustrates an exemplary hinge for use with the seat base of the birthing chair of the present invention.
Figure 4:
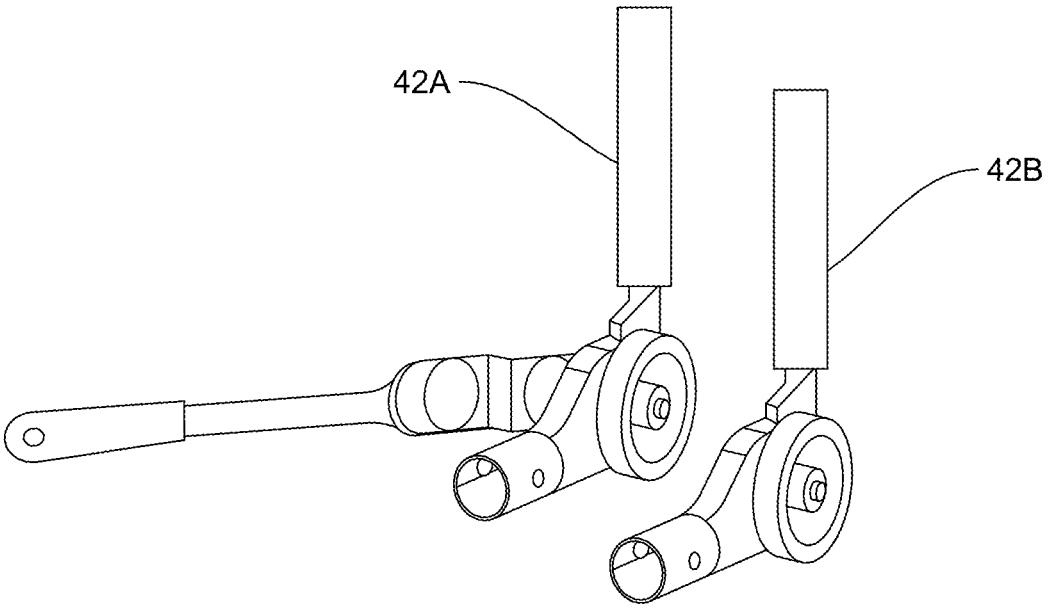
FIG. 4 illustrates an exemplary hinge for reclining the back of the birthing chair of the present invention.

Turning now to FIG. 2 but with continuing reference to FIG. 1, the seat base 14 may further comprise joint 28 at the distal side 30 of the seat 12 and joint 28B at the proximal side 32 of the seat. The seat base 14 and leg extensions 18A and 18B open and close laterally in the x and y directions at the joint 28 to enable the mother to separate her legs for delivery of her infant while remaining positioned in the birthing chair 10. In one embodiment of the invention, the joint 28 comprises a locking hinge, as shown in FIG. 3. However, it will be appreciated that the joint 28 may be any device that enables that seat base 14 and leg extension 18A and 18B to open laterally, including a detachable latch material such as hard plastic and metal.

For this purpose, it will be appreciated the birthing chair 10 comprises a saddlehorn 29 having a separation 31 therethrough to enable the leg extensions 18A and 18B to separate when the joint 28 is activated. The lateral separation of the seat base 14 and leg extensions 18A and 18B permits a separation of about five inches to about twelve inches at joint 28B and allows the detachable seat cushion 16 to be attached only when the seat base 14 is closed. In one embodiment of the invention, the leg extensions 18A and 18B open a maximum of seven inches at separation 31 in saddle 29. The joint 28 allow the seat base 14 to be separated when open and lock the seats base 14 together automatically when pushed together.

To unlock the seat base 14 and allow the legs extensions 18A and 18B to open, a release device 36 is located on the birthing chair 10 and activates the hinge 28. In one embodiment of the invention, the release device 36 comprises a lever or button located on the back of the birthing chair 10 on the back 40 of the chair and is in communication with the hinge 28, such that movement of the lever 36 activates the joint 28 and moves the seat base 14 and leg extensions 18A and 18B laterally. The release device 36 alternatively may also comprise a button that, when pushed, unlocks the hinge 28.

The birthing chair 10 of the present invention may further comprise a back 40. The back 40 may be custom built to the mother's specifications to accommodate her body type and size both during pregnancy and post-labor and delivery. Generally, the dimensions of the back 40 range from about 42 inches to about 60 inches in width, about 18 to about 22 inches in height and about 8 to about 10 inches in depth. In one embodiment of the invention, the back 40 measures 42 inches wide by 18 inches height and 10 inches deep.

The back 40 is attached to the seat 12 at the distal side 30 of the birthing chair 10 and is configured to allow the mother to rest her back or push against the back 40. The back 40 supports the mother's mid, upper and lower back during utilization of the birthing chair 10. The back 40 may be any shape but in one embodiment of the invention back 40 is rectangular. The back 40 comprises an inner foam cushion of upholstery, dacron, rebond foam, covered with polyester, rayon, elastomer, polyvinyl, or polyurethane. The back 40 may be any color or pattern.

The back 40 may be integrally formed with the seat base 14 or, alternatively, the back may be attached to the seat base 14. In those embodiments where the back 40 is attachable to the seat 40, two lateral hinges 42A and 42B are located on the back 40, one on each side of the birthing chair 10. The lateral hinges 42A and 42B connect the back 40 to the seat base 14 and enable the back 40 to recline to about 30 degrees when activated. The lateral hinges 42A and 42B are made of any materials including, metal, polypropylene, hard plastics, brass and steel. In one embodiment of the invention, the hinges 42A and 42B comprise reclining chair hinges, as shown in FIG. 3. Additionally, lateral hinges 42A and 42B may comprise polypropylene, hard plastics and metals, including brass and steel. The size of the lateral hinges 42A and 42B ranges from about 3 to about 5 inches long and 3 to 5 inches in height.

The birthing chair 10 may further comprise a headrest 48 located above the back 40. The headrest 48 is proportional to the back 40 and is sized and shaped to fit the mother's needs. The headrest 48 support the mother's head and neck while utilizing the birthing chair 10. The dimensions of the headrest 48 may range from about 4 inches to about 6 inches in width, from about 7 inches to about 9 inches in height and about 3 inches to about 5 inches in depth. The shape of the headrest 48 may be any shape that accommodates the head of the mother. In one embodiment of the invention, the headrest is rectangular. The headrest 48 may be integral with the back 40 as one unit, or, optionally, the headrest 48 may be detachable. The headrest 48 comprises an inner foam cushion of rebond foam and dacron, covered with polyester, rayon, mesh, polyvinyl, elastomer and/or polyurethane. The headrest 48 may be any color or pattern.

The birthing chair 10 may further comprise pairs of leg straps 50A and 50B and 52A and 52B. The leg straps 50A and 50B are located at the medial sides 57A and 57B and lateral sides 58A and 58B of and are configured to contain and/or support the upper thighs of the mother's legs when utilizing the birthing chair 10. The leg straps 52A and 52B are located at the medial sides 57A and 57B and lateral sides 58A and 58B of the leg extensions 18A and 18B and are configured to contain and/or support the mid-thighs of the mother's legs when utilizing the birthing chair 10.

The leg straps 50A, 50B, 52A and 52B may be any material, including leather, fabric, plastic, Velcro, polyester, rayon and elastomer, mesh, polyvinyl. In one embodiment of the invention, the leg straps 50A, 50B, 52A and 52B are made of pairs of Velcro straps that, when connected, overlap to varying sizes to accommodate the legs of the mother and are adjustable for comfort and safety to secure the legs of the mother in the birthing chair 10. The leg straps 50A, 50B, 52A and 52B are for safety, holding the mother's legs in place while actively being seated in the birthing chair 10. The leg straps 50A, 50B, 52A and 52B are particularly useful during labor and delivery when the mother's legs are suspended in the birthing chair 10 in a manner yet to be described.

Figure 5:
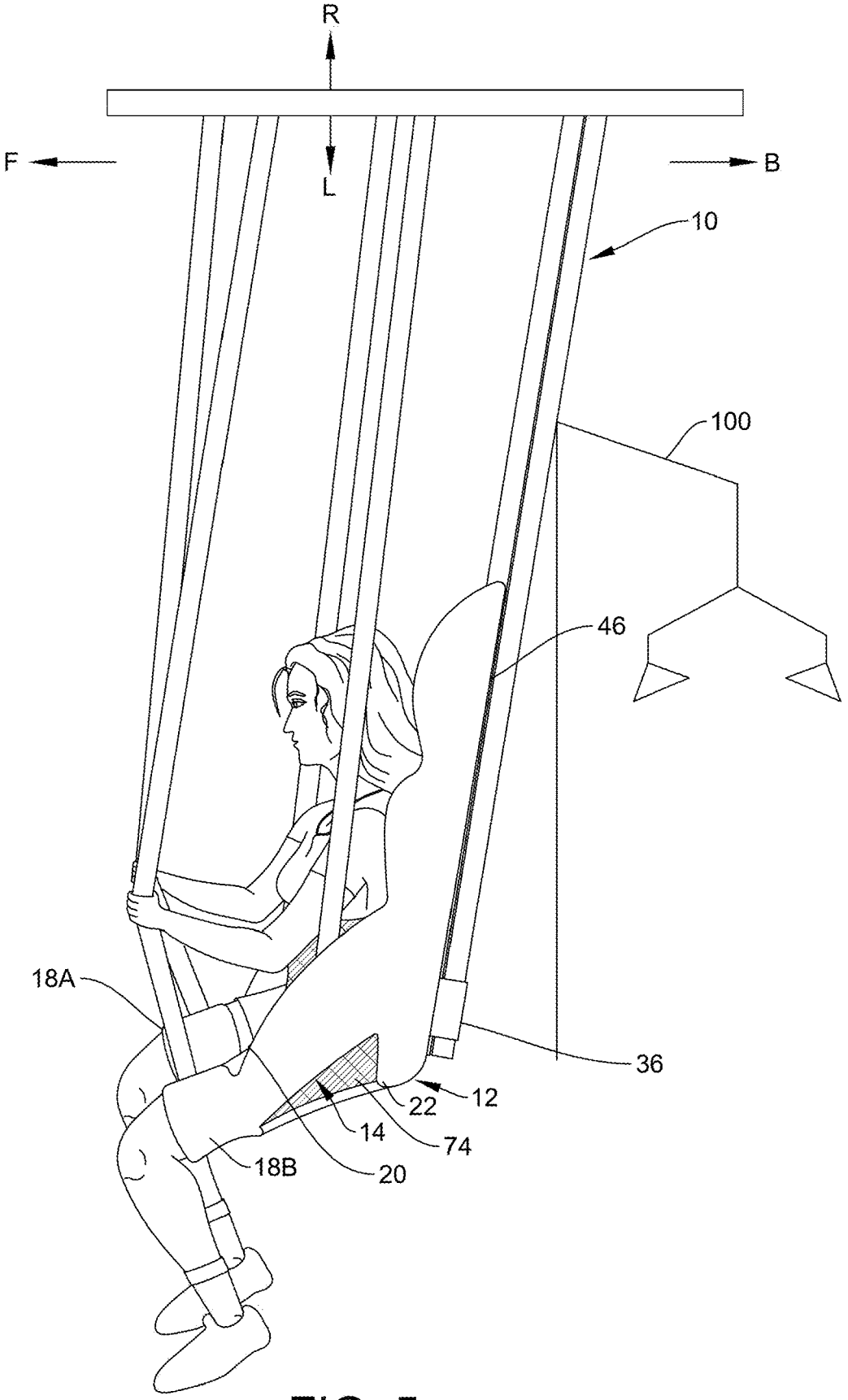
FIG. 5 is a side view showing the birthing chair of the present invention in use.

With continuing reference to FIG. 1, the birthing chair 10 may further comprise a suspension system 60 for suspending the birthing chair from a traction system, such as a Hoyer lift, as illustrated in FIG. 5, or a ceiling installation (not shown). The suspension system 60 comprises a plurality of support cords, 62A, 62B, 62C, 62D, 62E, 62F, 62G and 62H to support the birthing chair 10 at strategic points and enable the mother to maneuver with ease in any direction and at any height and to adjust her position in the chair as if in open space, while simultaneously maintaining comfort and support of her body in a substantially upright posture. It will be appreciated that the birthing chair 10 may comprise fewer or more support cords than shown in FIG. 1.

Support cords 62A and 62B are located bilaterally at the seat 12 or at the jointure between the seat base 14 and the back 40 adjacent the lateral hinges 42A and 42B. Support cords 62A and 62B enable maneuverability of the birthing chair 10 at the back of the chair in 360 degrees at any height.

Support cords 62C and 62D are located bilaterally of the leg extensions 18A and 18B. Support cord 62C is connectable to the birthing chair 10 at the lateral side 58A of the leg extension 18A, proximal the leg straps 50A. Support cord 62D is connectable to the birthing chair 10 at the lateral side 58B of the leg extension 18B, proximal the leg straps 50B. Support cords 62C and 62D enable maneuverability of the birthing chair 10 at the upper thighs of the mother in 360 degrees and at any height.

Support cords 62E and 62F also are located bilaterally of the leg extensions 18A and 18B. Support cord 62E is connectable to the birthing chair 10 at the lateral side 58A of the leg extension 18A, proximal the leg straps 52A. Support cord 62F is connectable to the birthing chair 10 at the lateral side 58B of the leg extension 18B, proximal the leg straps 52B. Support cords 62E and 62F enable maneuverability of the birthing chair slightly above the knees of the mother in 360 degrees and at any height.

Support cords 62G and 62H also are located bilaterally of the leg extensions 18A and 18B. Support cord 62G is connectable to the birthing chair 10 at the medial side 58B of the leg extension 18A, proximal the leg straps 52A. Support cord 62H is connectable to the birthing chair 10 at the medial side 58B of the leg extension 18B, proximal the leg straps 52B. Support cords 62G and 62H enable maneuverability of the birthing chair 10 slightly above the knees of the mother in 360 degrees and at any height.

The support cords 62A through 62H are composed of materials that allow resistance against partial or complete weight bearing of the mother when seated in the birthing chair 10. In one embodiment of the invention, the support cords 62A through 62H are composed of materials having stretch, such as elastic or rubber and that enable the mother to move the birthing chair 10 up, down, forward, backward, sideways and diagonally and to tilt the chair in any direction and at any height, in 360 degrees. Some suitable materials useful in the manufacture of the support cords 62A through 62H include rubber, elastic, bungee cords, polypropylene, plastics, and combinations thereof.

The support cords 62A through 62H are based on the size of the chair but may range in length from about two to about seven feet long. The length of the support cords 62A through 62H may be adjusted. The support cords 62A through 62H comprise one or more loops 64.

Each support cord 62A through 62H comprise a loop, hook, or other support cord attachment means 64A through 64H at each end of each support cord for attachment to a carabiner clip 70 at one end and a traction system (not shown) at the other end. The bungie strap loops are composed of polyester, rayon, elastomer, polyvinyl, polyurethane, and/or vinyl. In one embodiment of the invention, each support cord attachment means 64A through 64H comprises single loop that is two inches wide by two inches long.

Each support cord attachment means 64A through 64 H is attached to adjustment loops 66A through 66H via a carabiner clip 70 or other connecting means. The carabiner clip or other connecting means 70 is capable of holding up to 300 lbs in the birthing chair 10. The carabiner clip or other connecting means 70 is composed of aluminum or other strong materials, such as including fabrics. The carabiner clip or other connecting means 70 ensures safety and minimal physical effort by the mother in the chair while also acting as a friction brake.

Attached to each carabiner clip 70 are adjustment loops 66A through 66H, which are configured to shorten or lengthen the support cords 62A through 62H, and adjust the height of the birthing chair 10, in order for the mother to be either partially weightbearing, fully weightbearing or non-weightbearing while seated in the birthing chair. In one embodiment of the invention, each adjustment loop 66A through 66H comprises a plurality of three loops at the beginning of each support cord 62A through 62H. The adjustment loops 66A through 66H may be made of the same material as the support cords 62A through 62H, such as rubber and elastic materials.

The birthing chair 10 may further comprise a belly strap 74 that spans the width of the seat 12 and is configured to safely retain the mother in the chair 10. In one embodiment of the invention, the belly seat strap is comprised of a soft, material that will safely secure a pregnant mother without placing pressure on her baby, such as rubber, Velcro, polyester, mesh, rayon materials. The belly strap 74 is stretchable or adjustable in size to fit the mother and further may be detachable from the birthing chair 10 by connecting means 76, such as Velcro materials located on the seat 12 of the birthing chair 10 and also on the ends of the belly strap 74. The belly strap 74 is adjustable to the size of the mother and generally is about one foot in width by, about twenty inches long by about one-half inch in thickness. The belly strap 74 may be any shape configured to hold the mother in the birthing chair 10. The belly strap 74 is used for the support, safety, and comfort of the mother while seated in the birthing chair.

The birthing chair 10 further may comprise stirrups 80 attachable to the leg extensions 18A and 18B and further may be recessed inside the leg extensions and concealed by cover 82. The stirrups 80 comprise footrests 88A and 88B which slide out of each leg extension 18A and 18B of the seat 12. In one embodiment of the invention, the stirrups 80 are released from the leg extensions 18A and 18B by activating a release mechanism (not shown) and detaching the stirrups cover 82. Once the stirrups cover 82 is detached, the stirrups 80 may be pulled out, and the stirrup feet 88A and 88B unfolded and fully extended away from the seat 12 of the birthing chair 10.

The footrests 88A and 88B are configured to receive the mother's foot during delivery. In one embodiment of the invention, the footrests 88A and 88B have oval bases for receiving the ankle, with a lip extending up both sides of the footrests. It will now be appreciated that the mother may be fully supported in the birthing chair 10 and completely non-weightbearing therein, suspended by the support cords 62A through 62H, and stirrups 80 and footrests 88A and 88B. The mother also may be moved in this position by a Hoyer lift 100, traction system or other lift mechanism.

The stirrups 80 may to be folded at stirrup legs 86A and 86B, which may be made of plastic or metal. The stirrup cover 82 may be any shape to cover the opening of the recess into which the stirrups 80 recede inside the extensions legs 18A and 18B. In one embodiment of the invention, the stirrup cover 82 forms an aperture (not shown) through which is accessed the release mechanism to release the stirrups 80 and extend them for use. The cover 82 may be made of plastic, mesh or metal.

The birthing chair 10 may further comprise handles 90A and 90B which are attached bilaterally to the outside of the seat 12. The handles 90A and 90B are used for positioning, mobility, grasping and comfort for the mother while seated in the birthing chair 10. The shape of the handles 90A and 90B may be any shape which may be grasped for this purpose, such as a D-shape, oblong, and ovular. The handles range from about 6 to about 7 inches long, 2 to 4 inches wide and 2 to about 3 inches deep. In one embodiment of the invention, the handles 90A and 90B are six inches long, three inches wide and one inch deep. The support handles protrude outward by 3 inches in order for the mother to grip the actual handle. The support handles may be attached to the lateral sides of the seat 12 by an aluminum, L-shaped hinge. The handles may be covered with a foam rubber cushion for gripping and for comfort.

Turning now to FIG. 5, but with continuing reference to FIGS. 1 and 2, the operation of the invention will now be described. The foregoing description of the birthing chair 10 is incorporated herein. The mother is situated in the seat 12 of the birthing chair 10, and the support cords 62A through 62H are adjusted for her body size and type. The belly strap 74 is secured over the mother to retain here in the birthing chair 10. The mother may in 360 degrees, whether up, down, back front, sideways, diagonal and at any height. During the early stages of labor, the seat base 14 remains locked in place.

As the mother reaches the transition phase of delivery when the infant is ready to be born, the detachable seat cushion 16 is removed and the joint 28 is released, allowing the seat base 14 and the leg extensions 18A and 18B to separate and enable the mother to open her legs for delivery of her baby through the aperture 22, which is made even larger by the activation of joint 28 and the unlocking of the seat base 14 and leg extensions 18A and 18B. Stirrups 80 may be released for receiving the feet of the mother, should she feel more comfortable in a partially recumbent position. However, the stirrups 80 may remain retracted inside the extension legs 18A and 18B and not used at all.

The mother may be fully supported in the birthing chair 10 or may be partially or completely weight bearing at any time during labor and delivery. The birthing chair 10 may be hoisted and moved with the mother secured therein. For example, the mother may be moved while secured within the birthing chair 10 to a birthing tub for delivery of the infant in a warm water bath or moved to a surgical bed for performance of a Cesarean section or for receiving medical attention.

The birthing chair 10 also is useful for relaxation and comfort both pre- and post-labor and delivery. The mother may prepare for labor and delivery by practicing in the birthing chair 10 prior to the birth of her child. The birthing chair 10 also may be enjoyed after childbirth by rocking and feeding the baby while seated comfortably in the chair.

It now will be appreciated that the present invention presents a new birthing chair that overcomes deficiencies of conventional birthing chairs and is useful throughout pregnancy, labor and delivery and post-partum. The birthing chair of the present invention provides increased comfort and supports the mother's body in any position, whether forward, backward, sideways, diagonally, low or through the use of a suspension system. The suspension system enables the mother to operate the chair to adjust her position and height at will. The birthing chair of the present invention allows the mother to adjust the height of the seat to allow the mother to squat close to the floor or to sit up higher in a vertical yet partially recumbent repose and to elevate her legs during delivery. The birthing chair of the present invention fully accommodates the mother in a comfortable seated position for use during pregnancy, labor and post-delivery, yet allows the removal of a portion of the seat for delivery of the infant.

The invention has been described above both generically and with regard to specific embodiments. Although the invention has been set forth in what has been believed to be preferred embodiments, a wide variety of alternatives known to those of skill in the art can be selected with a generic disclosure. Changes may be made in the combination and arrangement of the various parts, elements, steps and procedures described herein without departing from the spirit and scope of the invention as defined in the following claims.

I claim:

1. A birthing chair for a mother to facilitate labor and delivery of an infant, the birthing chair comprising:

a seat, the seat comprising:

a seat base forming an aperture; and a detachable seat cushion connectable to the seat base over the aperture;

leg extensions configured to receive the legs of the mother;

a joint that laterally opens the seat base and the leg extensions; and wherein, when the seat cushion is detached from the seat base, the seat permits vaginal delivery of the infant through the seat base.

2. The birthing chair of claim 1 wherein the seat base further comprises a flared lip.

3. The birthing chair of claim 2 further comprising a belly strap attachable to the seat, wherein the belly strap is adapted to extend across the abdomen of the mother while seated in the birthing chair and to secure the mother therein.

4. The birthing chair of claim 1 further wherein the joint comprises a hinge that unlocks the seat base and the leg extensions to open and locks the seat base and the leg extensions to close.

5. The birthing chair of claim 1 further comprising a back contiguous with the seat.

6. The birthing chair of claim 5 further comprising a headrest contiguous with the back.

7. The birthing chair of claim 1 further comprising at least one leg strap.

8. The birthing chair of claim 7 further comprising at least two pairs of leg straps in communication with the leg extensions for holding the upper thighs and the lower thighs of the mother while situated in the birthing chair.

9. The birthing chair of claim 1 further comprising a suspension system adapted to enable the mother to move in any direction while situated in the birthing chair.

10. The birthing chair of claim 9 wherein the suspension system comprises a plurality of support cords.

11. The birthing chair of claim 10 wherein the plurality of support cords comprises four pairs and wherein:

one pair of support cords is configured to be attachable to the birthing chair at the seat;

one pair of support cords is configured to be attachable to the leg extensions proximal the upper thighs of the mother;

one pair of support cords is configured to be attachable to the leg extensions proximal the mid-thighs of the mother; and one pair of support cords is configured to be attachable to the leg extensions proximal the knees of the mother.

12. The birthing chair of claim 9 wherein the suspension system is attachable to a wall or ceiling.

13. The birthing chair of claim 11 wherein the support cords have a length and further comprising means for adjusting the length of the support cords.

14. The birthing chair of claim 13 wherein the means for adjusting the length of the support cords comprises adjustment loops that adjust the height of the seat of the birthing chair.

15. The birthing chair of claim 1 further comprising stirrups for receiving the feet of the mother, the stirrups attachable to the leg extensions.

16. The birthing chair of claim 1 further comprising at least one support handle proximal the seat, the at least one support handle adapted to be grasped by the mother to facilitate her mobility and comfort while seated in the birthing chair.

17. A method of facilitating childbirth, the method comprising the steps of:

providing a seat having a seat base and a detachable seat cushion on which a mother is situated;

removing the seat cushion from the seat base to provide an opening for vaginal delivery of an infant through the seat base; and separating the seat base to enlarge the opening through which the infant is delivered.

18. The method of claim 17 further comprising the step of providing a suspension system for the seat that enables the mother to move in any direction while situated on the seat.

19. The method of claim 17 further comprising the step of delivering the infant through the seat base.

20. The method of claim 17 further comprising the step of securing the mother to the seat with a belly strap.

21. The method of claim 17 further comprising the step of supporting the legs of the mother while situated in the seat.

22. The method of claim 17 further comprising the step of providing a handle for the mother to grasp during labor and delivery.

23. The method of claim 17 further comprising the step of providing support for the mother's feet while situated in the seat.

* * * * *